United States Patent [19]

Otting et al.

[11] Patent Number: 4,758,001

[45] Date of Patent: Jul. 19, 1988

[54] GOLF PRACTICE AIDS

[76] Inventors: Billy J. Otting, P.O. Box 270; Stanley L. Williams, Route 2, Box 1382, both of LaFayette, Ga. 30728

[21] Appl. No.: 79,593

[22] Filed: Jul. 30, 1987

[51] Int. Cl.[4] ..... A63B 69/36

[52] U.S. Cl. ..... 273/188 R; 273/183 B

[58] Field of Search ..... 273/188 R, 188 A, 183 B, 273/189 R, 189 A, 190 R

[56] References Cited

U.S. PATENT DOCUMENTS

| | | | |
|---|---|---|---|
| 4,147,356 | 4/1979 | Brandell | 273/188 A X |
| 4,651,994 | 3/1987 | Lee | 273/188 R X |
| 4,659,084 | 4/1987 | Vuick | 273/188 R X |

FOREIGN PATENT DOCUMENTS

| | | | |
|---|---|---|---|
| WO85/00529 | 2/1985 | PCT Int'l Appl. | 273/183 B |
| 1440215 | 6/1976 | United Kingdom | 273/188 R |

*Primary Examiner*—Carlton R. Croyle
*Assistant Examiner*—Paul F. Neils
*Attorney, Agent, or Firm*—Alan Ruderman

[57] ABSTRACT

Two golf practicing aids are disclosed, one for preventing the improper shift of a golfer's rear leg and the other for preventing the improper swaying of the golfer's hips. One of the aids includes a frame having a horizontal base, a pair of spaced apart standards at one end of the base, and an elongated arm extending from a central portion of the base and intermediate the standards. The arm is pivotably mounted on the base and may be adjustably attached to the standards at selected vertical locations. The free end of the arm has a yoke member against which the golfer may place his or her rear leg, and the base has gripping members for securely attaching to the ground. The other aid includes a belt having a U-shaped strip member projecting from the side thereof facing the forward direction in which the golfer is to hit the golf ball, the strip acting as a slideway along which a clip may slide. The clip is attached to one end of a rope having its other end secured to the ground in front of the golfer for precluding improper swaying of the hips yet permitting the hips to rotate correctly during the backswing. Additionally, a strip of material may be attached to the belt and extend down the front hip of the golfer, the strip having a band which may be secured about the golfer's thigh to provide additional restraint.

8 Claims, 2 Drawing Sheets

GOLF PRACTICE AIDS

BACKGROUND OF THE INVENTION

This invention relates to golf and more particularly to practice or teaching aids for golfers to prevent improper shifting of the golfer's rear leg and improper swaying of the golfer's hips.

In order for one to score well when playing the game of golf, the golfer must have a properly "grooved" swing, and this involves shifting the golfer's weight correctly without undo rearward shifting of the back leg or swaying of the golfer's hips during the backswing. Most golf novices have a tendency when shifting weight during the backswing to lean their body rearwardly by swaying or tilting their rear leg and knee. When this occurs the golfer's weight shifts too far rearwardly and does not return correctly as the golfer's body and golf club come forwardly. This generally results in the face of the club being too open on impact with the ball and not only results in loss of distance but also in the ball slicing, i.e., the ball spinning so as to curve in the lateral direction toward which the body faces, e.g., the right of a right-handed golfer. Additionally, if the golfer's hips sway rearwardly during the backswing, the rear leg bends and too much weight shifts to the rear foot resulting in a slice.

Most golfers have much difficulty in correcting these difficiences and some never do — even after obtaining professional help.

Although various devices have been proposed for these purposes in the prior art, none of the proposals appear to have found acceptance, either because they have not performed satisfactorily or were too complicated for their purposes. For example, in Brandell U.S. Pat. No. 4,147,356, a leg shift preventing device was proposed which included a foot rest upon which the rear foot of the golfer is placed, a bracket associated with the foot rest was to engage the rear leg when shifted too far rearwardly. Since most golfers, even when practicing, wear cleated golf shoes, this device is awkward in use. Devices for restraining hip sway have been numerously proposed in the prior art. Examples of devices of this type which are relevant to the present invention include the following U.S. Pat. Nos.: Ungar 1,561,960; Cushing 3,079,152; Sheldon 3,215,438; Fisher 3,442,513; Wilson 3,870,317; Dickey 3,940,144; and Arena 4,134,589. However, none of these devices sufficiently precludes hip sway while permitting the required pivoting of the hips throughout the backswing and forwardswing of the golfer.

SUMMARY OF THE INVENTION

Consequently, it is a primary object of the present invention to provide apparatus for aiding a golfer during practice which prevents improper shifting of the golfer's rear leg and improper swaying of the golfer's hips so that the golfer can obtain a correctly "grooved" swing.

It is another object of the present invention to provide apparatus including a frame positionable on the ground having an adjustable arm including a yoke for abuttingly receiving the leg of a golfer, the frame having means for fixing it in the ground so that the yoke is stationary against the force of the golfer's rear leg.

It is a further object of the present invention to provide apparatus which may be readily assembled and dissassembled, the apparatus comprising a frame positionable on the ground and held stationary thereon, and including an arm having a yoke on a free end thereon, the arm being pivotably adjustable relative to the frame so as to be disposed to abut the leg of a golfer while practicing to prevent the golfer's leg from shifting rearwardly.

It is a still further object of the present invention to provide a belt positionable about the waist of a golfer, the belt including means for slidably attaching one end of a line, the other end of the line having means for affixing it to the ground forward of a golfer's front legs so as to prevent swaying of the golfer's hips during the backswing while practicing.

It is still a further object of the present invention to provide a belt adapted to be worn by a golfer while practicing, the belt having a projecting strip at the side thereof facing in the forward or leading direction relative to the golfer's stance, means slidably connecting one end of a line on the strip, and means for connecting the other end of the line to the ground forward of the golfer to restrain a golfer's hips during the backswing yet to permit the hips to pivot properly.

It is yet a still further object of the present invention to provide a belt adapted to be worn by a golfer while practicing, the belt including means for slidably connecting one end of a line, the other end of the line having means for affixing it to the ground forward of the golfer's front leg so as to prevent sway of the golfer's hips, and including a strip of material extending from the belt downwardly along the leading leg, and means for attaching the strip about the thigh of the golfer's leading leg.

Accordingly, one aspect of the present invention is to the provision of apparatus comprising a frame including a horizontal base, a vertical standard upstanding at one end of the base and an elongated arm extending from a central portion of the other end of the base toward the standard, the arm being pivotably mounted so as to be adjustably connected to the standard intermediate its length and having a yoke at its free end. The base includes spikes or the like which engage into the ground, and a golfer may position his rear leg into the crotch of the yoke member which acts as an abutment to prevent the golfer's leg from shifting rearwardly while swinging the club during the backswing during practice. Preferably the apparatus is constructed from light weight tubular elements and may be readily assembled and dissassembled as necessary.

Another aspect of the present invention is the provision of a belt positionable about the waist of a golfer, the belt including an outwardly projecting strip of material at one side thereof for slidably attaching a connecting member, the connecting member being secured to one end of a line having its other end attached to a stake in the ground forwardly of the golfer's front leg so as to restrain the hips of the golfer from swaying during the backstroke of the golf club during the golf swing. The slidable connection is such that it permits the hips to correctly pivot or rotate while restraining improper swaying action. Another aspect of this invention is tne provision of a strip of material extending downwardly from the belt along the golfer's hip and attached to a member fastened about the thigh of the leading leg of the golfer so as to further restrain the rearward swaying action of the hips.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENTS

Figure 1:
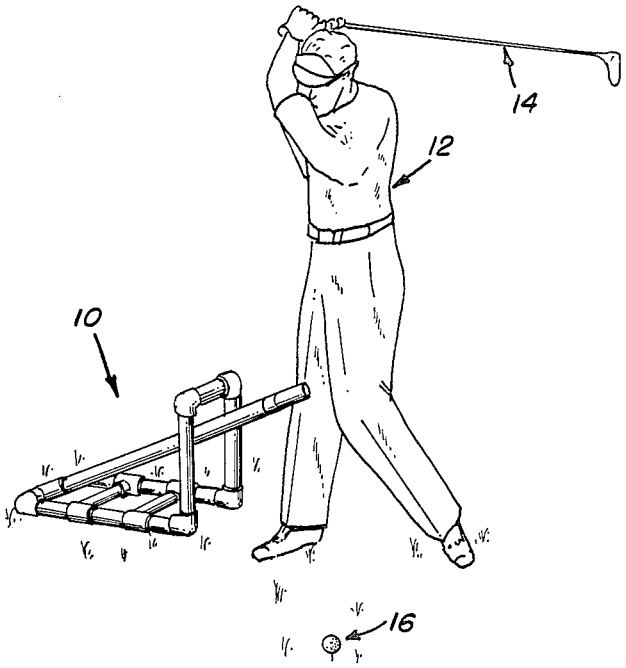
FIG. 1 is a perspective view of a rear leg shift preventing apparatus disposed in operative position against the rear leg of a golfer.
Figure 3:
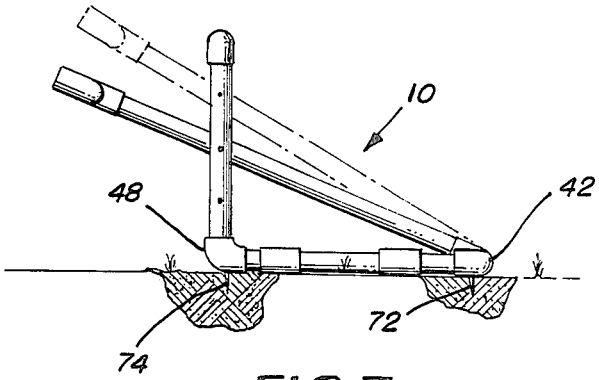
FIG. 3 is a side elevational view illustrating the apparatus of FIGS. 1 and 2 in two adjustable positions and depicting the ground fastening means.
Figure 2:
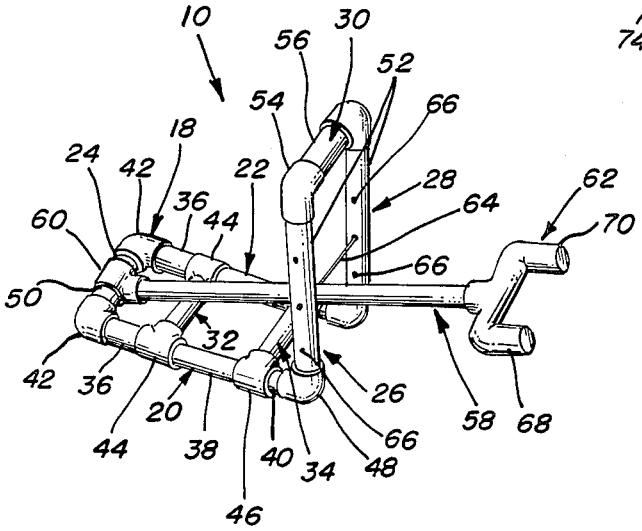
FIG. 2 is an enlarged perspective view of the apparatus illustrated in FIG. 1.

Referring to the drawings, and particularly to FIGS. 1 through 3, apparatus for preventing improper rearward shifting of a golfer's rear leg is illustrated, the apparatus 10 being depicted in the operative position while a golfer 12 is in the midst of his swing and the golf club 14 is at the uppermost position just prior to the downswing toward the ball 16. The apparatus, which preferably is constructed from lightweight tubing, such as PVC pipe, comprises a base 18 adapted to be disposed on the ground and having a pair of spaced apart support rail members 20, 22 interconnected together at the rear end by a rear support rail 24. At the front of the rails 20, 22 there is a respective upstanding standard 26, 28, the upper ends of which are connected together by a lateral brace 30. Additional braces 32, 34 preferably connect the rail members 20, 22 together to provide a rigid structure.

As aforesaid, the apparatus is preferably constructed from PVC pipe which, for ease of transport, may have threaded members which may be assembled and dissassembled readily. Thus, the rails 20, 22 may each comprise respective pipe members 36, 38, 40, the members 36 being connected to respective elbow members 42 at one end and a Tee connector 44 at the other end. Each of the Tee connectors 44 connect the member 38 with another Tee connector 46 which connects the member 40 to an elbow 48. The elbows 42 are connected together by a pipe 50, while the elbows 48 connect pipes 52 to elbows 54. The elbows 54 together with a connecting pipe 56 thereby comprises the brace 30. The braces 32, 34 are formed in a similar manner by pipe connected to the respective Tee connectors 44, 46.

Disposed intermediate the standards 26, 28 is a leg restraining member 58 comprising a tubular form and preferably having a sleeve 60 at its other end, the sleeve being journalled on the pipe 50 so as to pivotably rotate relative thereto. Thus, the front of the restraining member 58 may be elevationally adjusted relative to the base. At the forward end of the restraining member 58 is a forked yoke 62 which also preferably is formed from PVC. A pin or rod 64 extends between the standards 26, 28 received through a selective respective pair of holes 66 spaced vertically apart and a hole extending through the member 58. Preferably there are at least three sets of adjusting holes 66. The pin or rod 64 may have a head on one end and a threaded cap on the other end for selectively positioning it through the member 58 and the selected pair of holes 66. Hence, the yoke 62 may be positioned at the proper elevation for receiving the leg of the golfer between the tines 68, 70 as illustrated in FIG. 1.

At the bottom of the base 18 the apparatus 10 includes ground gripping members such as spikes 72, 74, which preferably may be secured to the members 42, 48 respectively. In use, the golfer will position his or her leg within the yoke 62 and during the backswing the yoke will engage and prevent the leg from shifting or tilting rearwardly. By using the apparatus during practice, the golfer can develop the attributes to correctly stroke the ball.

Figure 4:
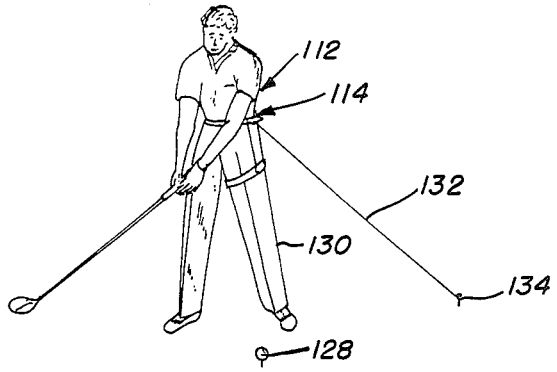
FIG. 4 is a perspective view illustrating a second aspect of the present invention for precluding improper hip sway and depicting a golfer initiating his backswing.
Figure 5:
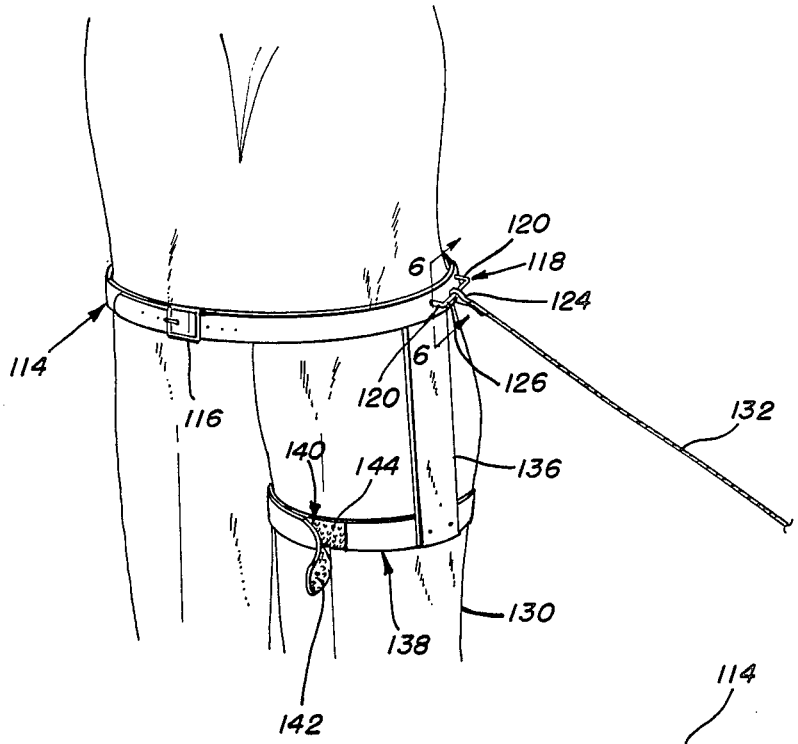
FIG. 5 is an enlarged perspective view of a portion of the apparatus illustrated in FIG. 4.
Figure 6:
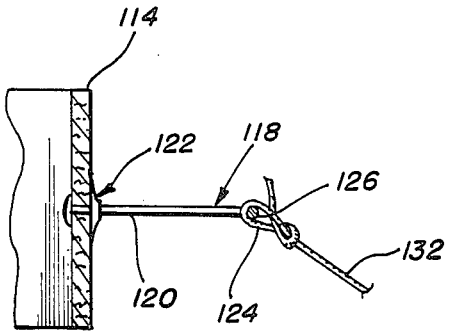
FIG. 6 is a fragmentary cross sectional view taken along line 6—6 of FIG. 5.

Referring to FIGS. 4 through 6, apparatus for restraining the rearward swaying of the hip of a golfer 112 while permitting the hips to rotate during the backswing comprises a belt 114 conventionally adjustably positioned about the golfer's waist by buckle means 116, the belt having a protruding strip of material 118 extending from one side thereof. Preferably the strip 118 comprises a metal member arched or bowed to have a substantially U-shaped configuration, and may be formed from thin rod or rigid wire. The spaced apart limbs 120 of the strip 118 are attached to the belt by any convenient securing means such as rivets or rivet-like members 122 disposed on opposite surfaces of the belt which is securely sandwiched in between, the limbs extending sufficiently from the belt such that a hook or clip 124 may freely slide along the spanning or bridging portion 126 of the strip 118.

The strip 118 projects outwardly from the side of the belt facing the direction in which the golfer is to drive the ball 128, i.e., outwardly from the leading or forward leg 130 of the golfer. Thus, for a right handed golfer, the strip 118 is disposed on the left side and vice versa for a left handed golfer. The hook or clip 124 is fastened to one end of a flexible line such as a rope 132 or the like, and the other end of the line is fastened to a peg or spike 134 secured within the ground forward of the golfer's leading leg 130, the rope being taunt as the golfer commences the backswing. During the golfer's backswing he or she is thereby restrained about the hips from swaying rearwardly as the rope 132 acts against the rearward pulling force exerted by the golfer's hips.

The length of the bridging portion 126 of the strip 118 should be such that the clip 124 may slide a distance for permitting the golfer's hips to rotate through the proper angular relationship during the backswing to obtain sufficient movement of the golfer's upper torso. To this end it has been found that a bridging portion length of approximately 4 inches provides the appropriate sliding movement for permitting proper hip rotation while restraining hip sway with the line 132 fastened to the ground a few feet in front of the golfer.

In order to provide greater restraint, and so that the belt 114 does not slide about the golfer's waist, an additional support preferably may be provided in the form of a leather or fabric strip 136 attached at one end to the belt 114 on the same side of the waist as the strip 118 and extending downwardly along the hip of the leg 130. The other end of the strip 136 is secured to a band 138 adapted to encircle the golfer's thigh, the band having fastening means 140 for removeably and adjustably attaching its ends together. Preferably the means 140 comprises synthetic plastic hook and loop elements 142, 144 which rapidly interlock together, such as hook and loop elements being sold under the VELCRO brand name. Accordingly, the band may be secured about the thigh of the golfer to provide a balancing of the attachment of the line 132 and an additional restraint against hip sway.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. Apparatus for preventing the rearward shifting of a golfer's rear leg while practicing the game of golf, said apparatus comprising a frame including a base and an upstanding support means at one end of the base, said base having a bottom surface positionable upon a support surface, means on the bottom surface for grasping said support surface firmly, said support means comprising a pair of spaced apart standards, a restraining arm having one end pivotably journalled on said base and disposed intermediate said standards, a yoke fastened to said arm remote from said one end, said yoke having spaced apart tines defining a crotch therebetween for receiving the rear leg of a golfer, and means for adjustably connecting said arm to said standards intermediate said one end and said yoke at selected vertical locations along said standards, whereby the leg of the golfer may abut the yoke within the crotch and during the backswing portion of a golf swing restrain said leg from shifting rearwardly.

2. Apparatus as recited in claim 1, wherein said restraining arm is positioned adjustably at angular inclinations relative to said support surface.

3. Apparatus as recited in claim 1, wherein at least said base and said standards comprise synthetic plastic tubing.

4. Apparatus as recited in claim 3, wherein said restraining arm is fastened to a sleeve at said one end, and said sleeve is journalled on said base.

5. Apparatus as recited in claim 1, wherein said base comprises a pair of spaced apart rails of finite length, spanning means connecting said rails together at respective ends thereof, said standards being fastened to a respective rail at ends remote from said spanning means, and journal means for pivotably mounting said restraining arm on said spanning means.

6. Apparatus as recited in claim 5, wherein at least said base and said standards comprise synthetic plastic tubing.

7. Apparatus as recited in claim 6, wherein said journal means comprises a sleeve journalled on said spanning means, and said restraining arm is fastened to said sleeve.

8. Apparatus as recited in claim 7, wherein said restraining arm is positioned adjustably at angular inclinations relative to said support surface.

* * * * *